United States Patent [19]

Strandwitz

[11] 4,243,861

[45] Jan. 6, 1981

[54] TOUCH SWITCH AND CONTACTOR THEREFOR

[75] Inventor: Peter Strandwitz, Neenah, Wis.

[73] Assignee: The Cornelius Company, Anoka, Minn.

[21] Appl. No.: 962,540

[22] Filed: Nov. 20, 1978

Related U.S. Application Data

[63] Continuation of Ser. No. 809,820, Jun. 24, 1977, abandoned.

[51] Int. Cl.[3] ..... H01H 13/14; H01H 1/02

[52] U.S. Cl. ..... 200/159 B; 200/5 A; 200/267; 200/340; 428/255

[58] Field of Search ..... 200/5 A, 86 R, 159 B, 200/262, 267, 292, 340; 340/365 R, 365 A, 365 E; 428/255

[56] References Cited

U.S. PATENT DOCUMENTS

| | | | |
|---|---|---|---|
| 3,056,005 | 9/1962 | Larson | 200/86 R |
| 3,222,237 | 12/1965 | McKelvy | 428/255 X |
| 3,437,973 | 4/1969 | Mabbett | 200/86 R X |
| 3,789,167 | 1/1974 | Seeger, Jr. | 200/159 B X |
| 3,987,259 | 10/1976 | Larson | 200/159 B X |
| 4,017,697 | 4/1977 | Larson | 200/159 B X |

*Primary Examiner*—Stephen Marcus

*Attorney, Agent, or Firm*—Henry C. Kovar

[57] ABSTRACT

An electrical touch switch having a printed circuit baseboard with two circuit patterns electrically isolated and spaced a predetermined distance from one another has a contactor having a resiliently flexible substrate with a plurality of small contactor dots positioned randomly with respect to the circuit patterns, each contactor dot is sufficiently large to span across the spacing between the circuit patterns and depression of any one of these dots against the circuit patterns will provide continuity between the circuit patterns; the contactor substrate also has embedded structural fibers which span across the contactor dots.

5 Claims, 6 Drawing Figures

TOUCH SWITCH AND CONTACTOR THEREFOR

RELATED APPLICATIONS

This application is a continuation of my co-pending U.S. application Ser. No. 809,820, filed on June 24, 1977 now abandoned.

BACKGROUND OF THE INVENTION

1. Field of the Invention

This invention pertains to an electrical touch switch having a resiliently flexible and depressible contactor sheet upon a relatively rigid printed circuit baseboard.

2. The Prior Art

The prior art touch switch has a relatively rigid baseboard with two or more circuit patterns which need to be electrically connected in order to provide continuity between the circuit patterns.

The contactor on the prior art touch switch has a substrate sheet of MYLAR, polycarbonate or polyester plastic of about 0.005 in. (0.13 mm) thick which is secured to the baseboard by some type of adhesive.

On the inner surface of the contactor sheet will be a conductive contactor dot which is normally held about 0.005–0.010 in. (0.13–0.25 mm) off of the circuit patterns by some type of spacer between the baseboard and the contactor. The conductive contactor dot typically is a painted-on area of a conductive paint having a powdered metal such as gold, silver, copper or aluminum for providing electrical conductivity. This conductive paint is usually applied by silk screening and resultant contactor dot is usually about 0.001 in. (0.025 mm) thick. The contactor dot typically is contiguous and has an area and a form precisely matching the area and form of the baseboard circuit patterns. The user of this touch switch places a finger against an outside surface of the contactor sheet and depresses the sheet and the contactor dot against the circuit patterns and upon contact of the contactor dot against both of the circuit patterns there is provided continuity between the patterns. When the switch user removes the finger, the resilience of the contactor sheet pulls the contactor dot off of the circuit patterns and continuity is broken.

Usually these touch switches involve a plurality of circuit patterns and there will be several individual switches in one assembled touch switch. Typical practice is to provide a single contactor dot for each pair of circuit patterns. A specific example of this type of contact switch would be for a calculator which would require separate individual switches for each of the numbers one through nine as well as more switches for the zero, decimal point and function selections.

The contactor for this type of switch requires that the substrate sheet be silk screened with conventional decorative paint to indicate whatever the purpose of a switch is to be, and then the substrate is again silk screened to apply the contactor dots. These contactor dots must be precisely registered with the indicia visible on the exterior side of the substrate. The entire contactor must then be precisely registered upon a baseboard so that each and every contactor dot precisely aligns with a respective pair of circuit patterns. If any contactor dot is not properly aligned or if any contactor dot is defective, the entire switch will be defective. It is inherent with this type of switch that a contactor having a given pattern of contactor dots is only useable on a corresponding baseboard and different contactors are required for each specific baseboard. Because of the registration problems inherent in the prior art, it is customary to make the contactor sheets one at a time.

The mylar substrate contactor has a maximum thermal tolerance range of −60° F. to +330° F. (−51° C. to 165° C.); the polycarbonate substrate has a maximum thermal tolerance range of −40° F. to +275° F. (−40° C. to +135° C.) and the polyester substrate has a maximum thermal tolerance range of −30° F. to +250° F. (−34° C. to +121° C.). Useage of touch switches has been restricted to environments in which these temperature ranges are not exceeded.

The foregoing substrate materials are also susceptible to penetration by objects such as pocket knives, pencil points and are also susceptible to being deformed by running a ball point pen over the substrate and atop of the contactor dot; this deforming is best envisioned as being considered a crease line. A crease line, as made by a pen or pencil, can deform the substrate enough so that the resiliency required to lift the contact dot off of the circuit patterns can be lost.

It has also been found that the corners and edges of the prior art contactor substrate sheets peel rather easily from the substrate board due to the pliable nature of the substrate.

It has also been found that the prior art contactor sheets tend to stress crack and break after use. The breaks almost always occur right across the contact dot. It is believed that one of the reasons for this phenomenon, which shortens the life expectancy of touch switches, is that the stiffest part of the contactor sheet is precisely where the contactor dot and the indicia are silk screened onto the substrate thereby increasing the thickness of the contactor sheet.

The most critical limiting factor in the useage of touch switches has been their limited current capacity due to the use of painted contactor dots. A further critical limitation has been the resistance across the painted contactor dots. Burning of the painted contactor dots has also been a problem.

The solvent resistance of the previous contactor sheet substrate has also been just more than sufficient.

OBJECTS OF THE PRESENT INVENTION

Accordingly, it is an object of the present invention to provide a touch switch having increased current capacity and less resistance.

It is an object of the present invention to provide a touch switch having a longer life expectancy.

It is an object of the present invention to provide a touch switch having a greater resistance to penetration or damage from application of objects against the switch contactor.

It is an object of the present invention to provide a contactor for a touch switch which does not require precise registration upon a switch baseboard.

It is an object of the present invention to provide a contactor for a touch switch which has a stronger contactor substrate.

It is an object of the present invention to provide a contactor for a touch switch which can be made in bulk sheets and be randomly trimmed in individual pieces for assembly to a switch baseboard.

It is an object of the present invention to provide a contactor for a touch switch which has a greater range of thermal tolerance, and greater resistance to solvents.

It is an object of the present invention to provide a touch switch in which the contactor sheet is more securely fastened to a switch baseboard and in which the peel resistance of the contactor sheet is increased.

It is an object of the present invention to eliminate the need for registration between contactor dots and indicia upon a contactor sheet for the contactor dots.

It is an object of the present invention to vastly increase the resistance of a touch switch to electrical deterioration from contact arcing.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

SUMMARY OF THE INVENTION

In accordance with the principles of this invention, a contactor for and on a printed circuit switch board having electrically isolated and spaced apart first and second contact grid circuit patterns has a substrate sheet, and a plurality of discrete electrically conductive contactor dots on the substrate sheet with the contactor dots having a major distance thereacross which is greater than the spacing between the circuit patterns with the contactor dots being depressible against the circuit patterns for providing continuity between the circuit patterns upon contact of any one of the plurality of contactor dots against the circuit patterns; a distinct feature of this invention is a contactor having structural fibers embedded in a substrate sheet and spanning across and supporting the contactor dots.

ON THE DRAWINGS

AS SHOWN ON THE DRAWINGS

Figure 1:
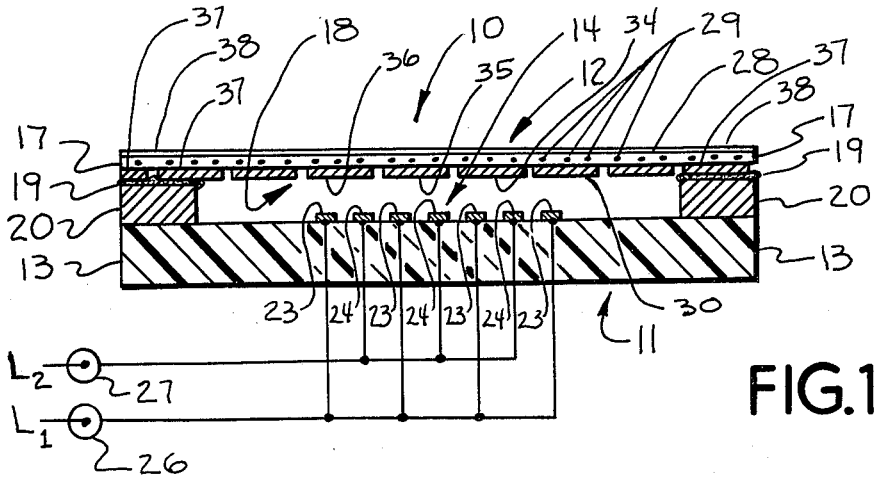
FIG. 1 is a cross-sectional elevational view of an electrical touch switch provided in accordance with the principles of the present invention.

The principles of the present invention are particularly useful when embodied in an electrical touch switch of the type illustrated in FIG. 1 and generally indicated by the numeral 10. The touch switch 10 has a baseboard generally indicated by the numeral 11 and a contactor generally indicated by the numeral 12.

The baseboard 11 has a rigid substrate 13 of 0.62 in. (1.6 mm) thick electrically non-conductive material such as fiberglass impregnated epoxy, the substrate 13 may be thicker and may be of other dielectric material. There is an electrically conductive contact grid generally indicated by the numeral 14 on the baseboard substrate 13. The contact grid 14 has a first electrically conductive circuit pattern 15 and a second electrically conductive circuit pattern 16. These circuit patterns 15, 16 are electrically isolated and physically spaced from one another.

The contactor 12 is in sheet form and has a substrate 17 of electrically non-conductive material. The conductor substrate 17 is perferably of a fiber impregnated resin of about 0.006 in (0.15 mm) thickness and is relatively flexible in comparison to the baseboard 11 as well as being resilient when flexed. There are electrically conductive contactor dots generally indicated by the numeral 18 on the contactor substrate 17. These contactor dots 18 are for providing electrical continuity between the circuit patterns 15, 16 as will be described. The contactor 12 is positioned on and secured to the baseboard 11 by an adhesive layer 19 applied on a margin 20 between the baseboard and contactor substrates 13, 17.

Figure 3:
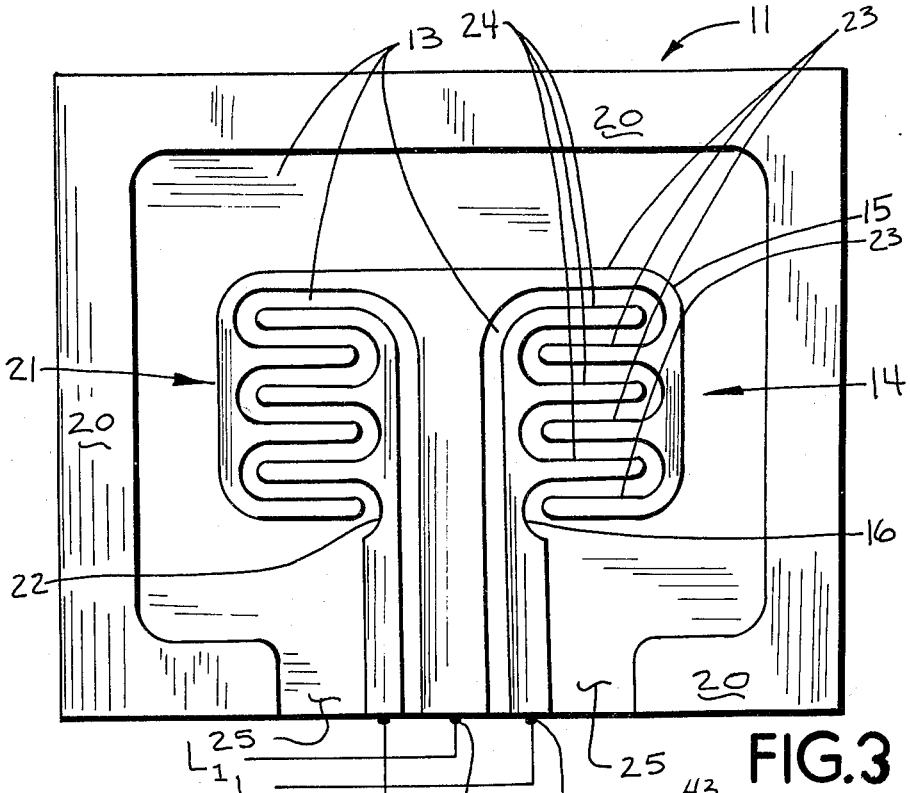
FIG. 3 is a top plan view of a printed circuit baseboard in the structure of FIG. 1.

FIG. 3 illustrates the contact grid 14 upon the baseboard 11. As shown, there may also be a second individual contact grid, generally indicated by the numeral 21 and in fact there may be more similar individual contact grids. The contact grid 14 has the first circuit pattern 15 and the second circuit pattern 16. The second contact grid 21 is shown sharing the first circuit pattern 15 which could be the electrically hot pattern and as having its own second circuit pattern 22. The first circuit pattern 15 has contact elements 23 and the second circuit pattern 16 has contact elements 24. The circuit patterns 15, 16 are of identical composition and preferably are of copper foil of at least 0.001 in. (0.025 mm) thickness which may be clad with a protective metal such as tin.

The margin 20 is secured on to the baseboard substrate 13 and is on at least two opposite sides of the contact grid 14 and preferably the margin 20 extends around and surrounds the contact grid 14; the margin 20 as shown is considered to surround the contact grid 14 even though an opening 25 is provided for routing of terminals 26 and 27 from the circuit patterns 15 and 16 respectively. The leads 26 and 27 are for connection of the circuit patterns 15, 16 to exterior electrical leads or exterior electrical leads elsewhere on what may be contiguous printed circuitry. The margin 20 is also preferably of metal and because of its conductivity, the margin 20 is electrically isolated and physically spaced from the contact grid 14. The margin 20 is about 0.010 in. (0.25 mm) thick and supports the contactor 12 above the contact grid 14 so that the contactor dots 18 are normally spaced from and not in contact with the contact grid 14.

Figure 4:
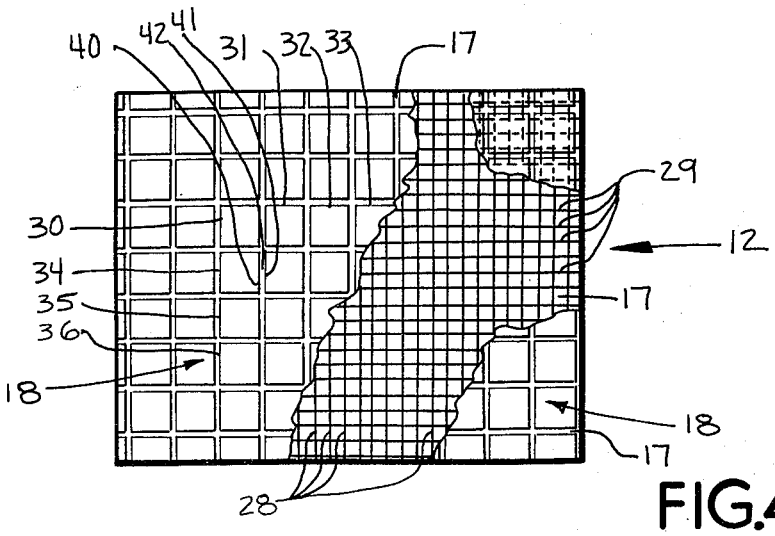
FIG. 4 is an interior plan view of the contactor on and for the structure of FIG. 1 and in accordance with the principles of the present invention.

The contactor substrate 17 is of an electrically non-conductive resiliently flexible sheet of resin, preferably epoxy resin, and preferably has, as is shown in FIG. 4, a plurality of structural fibers 28 which are parallel to each other and are in a layer extending over the area of the contactor substrate 17 and which are embedded in the contactor substrate 17 and which are electrically non-conductive. The preferred material for the structural fibers 28 is fiberglass. There preferably is a second plurality of structural fibers 29 which are also parallel to one another and which are substantially perpendicular to the first fibers 28. Both pluralities of fibers 28, 29 are in layers adjacent to each other and are embedded within the contactor substrate 17. Both pluralities of fibers 28, 29 extend from edge to edge and are in the entire area of the sheet of the contactor substrate 17.

An important feature of the contactor 12 is the contactor dots 18. There are a plurality of individual and discrete electrically conductive contactor dots, such as dots 30, 31, 32, 33, 34, 35, 36 on one surface of the contactor substrate 17. The contactor dots 18 are closely grouped together and a preferable density is fifteen to thirty dots per sq. cm. which provides a multitude of contactor dots 18 under the area of imprint of a human finger. A multitude of contactor dots 18 means there are a great many of dots 18 in the area defined by a human finger; specifically a multitude of about twenty-five of dots 18 under the area of a fingerprint has been found preferable. The contactor dots 18 are all of the same geometric shape and size and the illustrated square shape is thought to be preferable. The contactor dots 18 are preferably aligned in a first plurality of parallel rows extending from left to right in FIG. 4 and as one row is defined by the individual dots 30–33 being in a row, and a second plurality of parallel rows extending up and down and substantially perpendicular to the first rows as defined by the row formed by individual dots 30, 34–36. The contactor dots 18 are arranged in a uniformly repetitive pattern in which the dots 18 are all equadistantly spaced from one another. Each of the contactor dots 18 is preferably a layer of copper foil secured upon the contactor substrate 17 and the layer of copper foil may be covered by a protective metal such as tin. The metal contactor dots 18 are preferably at least 0.001 in. (0.025 mm) thick and are of the same composition of metal as the contact grid 14. The contactor 12 as shown in FIG. 4 may be randomly cut from a much larger bulk sheet (not shown) of material for such a contactor; as an example the bulk sheet could be perhaps a three foot square of material, a roll of material or a four foot by eight foot sheet, and an individual contactor just larger than a fingertip can randomly be cut from the bulk sheet.

The structural fibers 28,29 are directly under the contactor dots 18 and the fibers 28 and the fibers 29 are both spaced with respect to one another so that there is a plurality of each of fibers 28, 29 underlying each contactor dot 18. The contactor dots 18 are each larger than the spacing between adjacent parallel fibers 28 or fibers 29. Contactor dots 18 are arranged on contactor substrate 17 so that the fibers 28 forming the first layer are substantially parallel to the rown of contactor dots 18 parallel to the row defined by dots 30, 34, 35, 36 and substantially perpendicular to the rows of dots 18 parallel to the row defined by dots 30–33; and the fibers 29 forming the second layer are parallel to the row defined by dots 30–33 and substantially perpendicular to the rows parallel to the row defined by dots 30, 34, 35, 36.

The contactor 12 has metal dots 37 secured to the contactor substrate 17 which are identical to the contactor dots 18 but which serve as a different structure. The metal dots 37 are on a margin 38 of the contactor 12 and are secured to the baseboard 11 by the adhesive 19. The metal dots 37 are electrically isolated from the contactor dots 18 and in fact are an extension of the contactor dot pattern. The contactor 12 is the stiffest through the contactor dot 18 and metal dot 37 and by securing the metal dots 37 to the baseboard with adhesive 19, the peel resistance of the contactor 12 is greatly increased.

Figure 5:
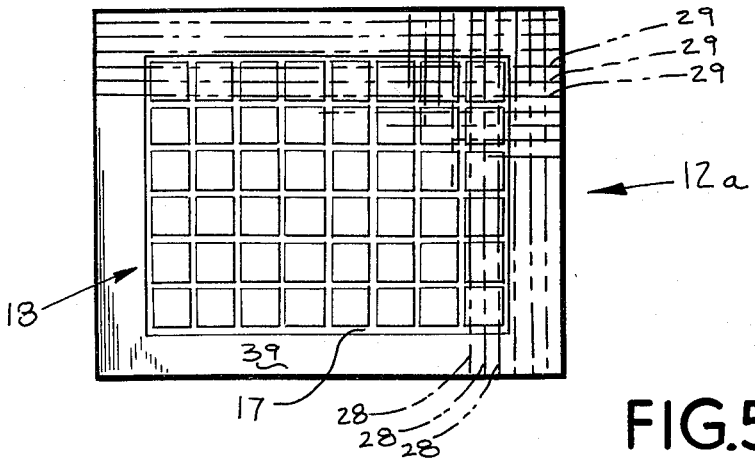
FIG. 5 is an interior plan view of an alternative embodiment of a contactor as in FIG. 4.
Figure 6:
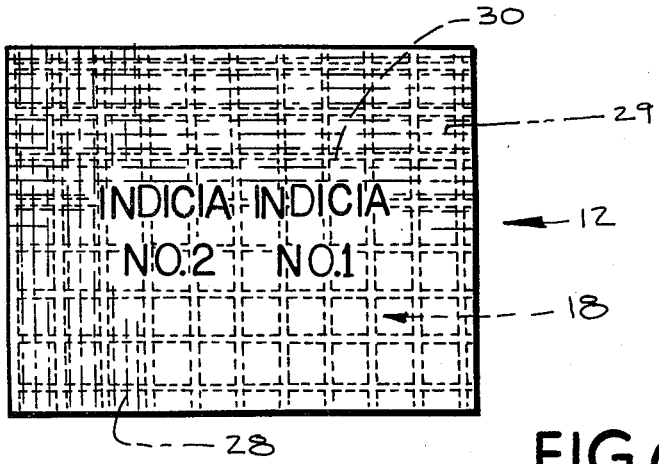
FIG. 6 is an exterior plan view of the contactor of FIG. 4.

A metal margin 39 is shown in FIG. 5 on an alternative and custom application contactor **12*a* wherein the contactor 12*a* is pre-cut to the size at which it is to be used. The metal margin 39 of contactor 12*a* is a continuous unbroken layer of metal around the periphery of the contactor 12*a*. This metal margin 39 is on the same side of the contactor 12*a* as are the contactor dots 18 and is electrically isolated from the contactor dots 18. The metal margin 39 and the contactor dots 18 are of the same composition of metal and are of the same thickness. The metal margin 39 gives the periphery of the contactor 12*a* extreme stiffness and when the metal margin 39 is secured to baseboard 11, the peel resistance of the contactor 12*a*** is very high.

The structural fibers 28, 29 extend across the contactor dots 18 and across the metal margin 39 of contactor **12*a*, and across and over the metal layer formed by the metal dots 37 of the margin 38 of contactor 12. The structural fibers 28, 29 also span over the spacing between the contactor dots 18 thereby increasing the flexibility of contactor 12 due to the fact that each contactor dot 18 has an edge 40 physically separated and spaced from another contactor dot edge 41 by a line 42 of exposed contactor substrate 17 and this line 42 of exposed contactor substrate 17 forms a hinge joint 43 between the contactor dot edges 40, 41 as the hinge joint 43 is much more flexible than that part of the contactor substrate 17 having the metal contactor dots 18** secured thereto.

An important feature of the touch switch 10 is the relative sizing and spacing between circuit patterns 15, 16, the contactor dots 18 and the metal margin 20. The circuit patterns 15, 16 as seen best in FIG. 3 are spaced apart from one another a predetermined and precise amount. Each of the contact elements 23, 24 is 0.020 in. (0.5 mm) wide and the adjacent contact elements 23, 24 are spaced apart from each other 0.020 in. (0.5 mm). The margin 20 is spaced from the outermost of the contact elements 23, 24 about 0.120 in. (3.05 mm) or more if compactness is of no concern. The contactor dots 18, as well as the conductive metal dots 37 are each 0.070 in. (1.8 mm) sq. and are spaced apart from each other 0.015 in. (0.38 mm). The minor or least distance across the surfaces of the contactor dot 18 is therefore 0.070 in. (1.8 mm) and the major or maximum distance across the contactor dots 18 is the diagonal distance of 0.099 in. (2.5 mm). If the contactor dots 18 were round, the major and minor distances would be one and the same and if the contactor dots were hexagonal, the major and minor distances would be of closer value, and if the contactor dots 18 were triangular, the major and minor distances would be of greater difference. The contactor dots 18 may be round, hexagonal, octagonal, triangular, rectangular or of other form.

Most importantly, the minor distance across the contactor dots 18 is greater than the spacing between the circuit patterns 15, 16 so that any one of the contactor dots 18 can make contact against at least one each of contact elements 23 and 24. The major and minor distance across the contact dots 18 is greater than the spacing between the contact dots 18 so that there is no possibility of the contact dots 18 straddling a circuit pattern 15 or 16 and the spacing between the contactor dots 18 is less than the spacing between the circuit patterns 15, 16 or the width of the circuit pattern contact elements 23, 24 for the same reason. The spacing between the contact grid 14 and the margin 20 is greater than the major distance across the contactor dots 18 so that there is no possibility of a contactor dot providing electrical continuity between any part of the contact grid 14 and the margin 20. In order to eliminate hairline contact or a condition of very little contact between one of contactor dots 18 and one of the circuit patterns 15, 16, the minor distance across the contactor dots is greater than the combined distance of the width of either contact element 23, 24 and the spacing between adjacent contact elements 23, 24. Preferably the minor distance across the contactor dots 18 is approximately equal to the width of two of contact elements 23 or 24 plus one and one-half times the spacing between adjacent contact elements 23 and 24 and as a result of this ratio, any one of contactor dots 18 is assured of contact against an area on each of contact elements 23, 24 which is equal to the maximum area coverable by one of the contactor dots upon any one of contact elements 23, 24.

Figure 2:
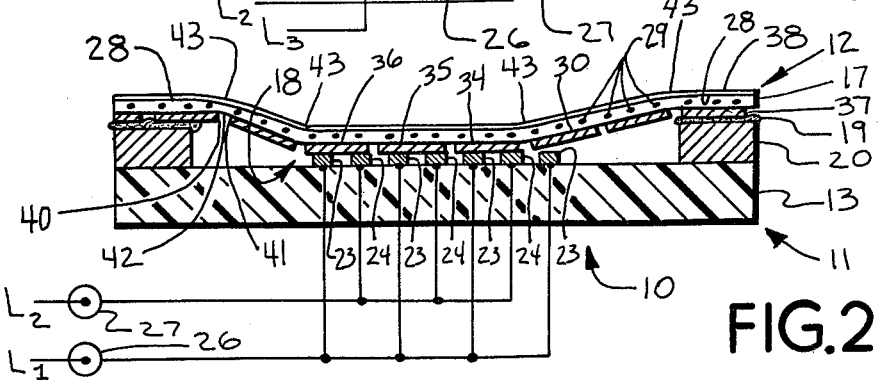
FIG. 2 is a cross-sectional view of the structure of FIG. 1 showing the contactor depressed against the circuit board.

In operation and use of the touch switch 10, the contactor 12 is normally flat as seen in FIG. 1 and the contact dots 18 are suspended above and out of contact with the contact grid 14 and there is no electrical continuity between the circuit patterns 15, 16. The user of the switch places a finger against the exterior of the contactor 12 and depresses the central part of the contactor 12 until one or more of the contactor dots 18 makes physical contact against the contact grid 14 as is shown in FIG. 2, providing electrical continuity between the circuit patterns 15, 16. When the user removes the finger, the natural resilience of the contactor substrate 17 returns the contactor 12 to a flat state and continuity between the circuit patterns 15, 16 is broken. The contactor 12 tends to flex the most in the hinge joints 43 and flexure of the contactor dots 18 is minimal and the force required to depress the contactor 12 is also minimized as well as the cycle life of the contactor substrate 17 being increased. The epoxy resin and fiber contactor substrate 17 extends the temperature tolerance range of the touch switch 10 to both higher and lower temperatures enabling its use in more severe environments as well as reducing damage to the switch from unusual exposures to temperature extremes. Specifically, the touch switch 10 is suitable for continuous duty at 400° F. (204° C.) and will survive intermittent temperatures of 500° F. (260° C.) and will also work without cracking at lesser temperatures than −60° F. (−51° C.). The solvent resistance of the resin and fiber substrate 17 is vastly superior to the previously used materials.

Some of the greatest advantages of the new touch switch of this invention are that the current capacity is increased five to one hundred-fold over the prior switch with the painted contactor dot, erosion of the contactor is greatly reduced because the metal contactors don't burn up, the contactor substrate is not exposed to as much heat because the metal contactor operates cooler, the resistivity of the switch is greatly reduced and the assembly and fabrication registration problems are eliminated. The contactor 12, previously described, can be randomly placed upon the baseboard 11 in any orientation, i.e. upside down, or diagonally, and the switch works absolutely perfect.

The contactor 12 can also be randomly applied upon two or more contact grids, for example the contact grids 14, 21 of the baseboard 11 in FIG. 3 and could cover ten, fifty, one hundred or more individual contact grids without any consideration whatsoever to registration between the contactor 12 and the baseboard 11.

Although other advantages may be found and realized and various modifications may be suggested by those versed in the art, it should be understood that I wish to embody within the scope of the patent warranted hereon, all such embodiments as reasonably and properly come within the scope of my contribution to the art.

I claim as my invention:

1. An electrical touch switch, comprising:

(a) an electrically non-conductive base board;

(b) an electrically conductive contact grid upon said board, said grid having (1) a first circuit pattern having means for electrical connection to a first electrical lead, and (2) a second circuit pattern electrically isolated and spaced a predetermined distance from said first pattern, and having means for electrical connection to a second electrical lead;

(c) means for securing a contactor sheet to said base board and atop of said grid;

(d) a contactor sheet secured to said board by said securing means, said contactor sheet having an inner surface facing towards, exposed to and spaced from said grid, and being resiliently flexible with respect to said board such that a portion of the contactor sheet facing directly against the grid may be manually depressed for biasing said sheet inner surface toward said grid; and (e) a plurality of discrete electrically isolated and electrically conductive contactor dots on the inner surface of said contactor sheet and facing directly against said first and second circuit patterns and being normally spaced from said patterns, said contactor dots each having a major distance thereacross which is greater than said predetermined distance between said first and second circuit patterns for providing electrical continuity between said patterns upon physical contact of any one of said contactor dots against said patterns, with every pair of adjacent contactor dots being identically equidistant from each other, and in which a minor distance across each contactor dot is greater than the combined distance of the spacing between said first and second circuit patterns and the width of a contact element of either circuit pattern.

2. A touch switch according to claim 1, in which the minor distance across each contactor dot is at least equal to the combined width of a pair of adjacent elements of said contact grid, and one and one-half times the predetermined distance between said adjacent contact elements.

3. An electrical touch switch, comprising:

(a) an electrically non-conductive baseboard;

(b) an electrically conductive contact grid upon said board, said grid having (1) a first circuit pattern having means for electrical connection to a first electrical lead, and (2) a second circuit pattern electrically isolated and spaced continuously equidistant from said first pattern, and having means for electrical connection to a second electrical lead;

(c) means for securing a contactor sheet to said baseboard and atop of said grid;

(d) a contactor sheet secured to said board by said securing means, said contactor sheet having an inner surface facing towards, exposed to and spaced from said grid and being resiliently flexible with respect to said board such that a portion of contactor sheet facing directly against the grid may be manually depressed for biasing said sheet inner surface toward said grid;

(e) a plurality of discrete electrically isolated and electrically conductive contactor dots on the inner surface of said contactor sheet and facing directly against said first and second circuit patterns and being normally spaced from said patterns, said contactor dots being identical to one another with each having a major distance thereacross which is greater than said predetermined distance between said first and second circuit patterns for providing electrical continuity between said patterns upon physical contact of anyone of said contactor dots against said patterns, and in which (f) said contactor dots are a uniformly repetitive pattern randomly positioned on said contactor sheet and with respect to said contact grid.

4. An electrical touch switch according to claim 3, in which said contactor has been randomly cut from a bulk sheet of contactor material.

5. An electrical touch switch, comprising:

(a) an electrically non-conductive baseboard;

(b) an electrically conductive contact grid upon said board, said grid having (1) a first circuit pattern having means for electrical connection to a first electrical lead, and (2) a second circuit pattern electrically isolated and spaced a predetermined distance from said first pattern, and having means for electrical connection to a second electrical lead;

(c) a contactor sheet secured to said board and having an inner surface facing towards, exposed to and spaced from said grid, said contactor sheet being resiliently flexible with respect to said board such that a portion of the contactor sheet facing directly against the grid may be manually depressed for biasing said contactor sheet toward said grid;

(d) a plurality of discrete electrically isolated and electrically conductive metal foil contactor dots in a continuous repetitive pattern on the inner surface of said contactor sheet, some of said dots facing directly against said first and second circuit patterns and being normally spaced from said patterns, said contactor dots each having a major distance thereacross which is greater than said predetermined distance between said first and second circuit patterns for providing electrical continuity between said patterns upon physical contact of one of said contactor dots against said patterns;

(e) a metal margin on said baseboard, said metal margin being on opposite sides of and on the same side of the baseboard as said contact grid and being electrically isolated from said grid and spaced from said grid a distance greater than the major distance across any discrete contactor dot; and in which (f) some of said contactor dots are secured to said baseboard metal margin, said contactor sheet being secured to said board via such secured contactor dots.

* * * * *